United States Patent [19]

Davis

[11] 4,008,852

[45] Feb. 22, 1977

[54] APERTURED MAILING CARD AND METHOD OF USING

[76] Inventor: Elmer O. Davis, 762 La Mesa Drive, Salinas, Calif. 93901

[22] Filed: Feb. 3, 1976

[21] Appl. No.: 654,794

[52] U.S. Cl. ..... 229/92.3; 229/92.8

[51] Int. Cl.[2] ..... B65D 27/04

[58] Field of Search ..... 229/92.8, 92.3, 71

[56] References Cited

UNITED STATES PATENTS

| | | | |
|---|---|---|---|
| 1,214,867 | 2/1917 | Young | 229/71 |
| 1,946,751 | 2/1934 | McCarthy | 229/92.3 |
| 2,209,601 | 7/1940 | Heywood | 229/92.8 X |
| 2,871,601 | 2/1959 | Warnow | 229/71 X |
| 2,985,464 | 5/1961 | McFarland | 229/92.3 X |
| 3,174,244 | 3/1965 | Walton | 229/92.3 X |

*Primary Examiner*—Stephen P. Garbe
*Attorney, Agent, or Firm*—Burns, Doane, Swecker & Mathis

[57] ABSTRACT

A mailing card comprises first and second card sections which are foldable together. The first card section contains an adhesive surface for carrying an object such as a photograph. A removable backing sheet overlies the adhesive surface. The second card section has an opening situated for general alignment with the adhesive surface when the first and second card sections are in a folded condition. A transparent cover extends across the opening. A sealing strip extends along the second card section and is foldable into engagement with the first card section to secure the sections in a folded condition. The first and second card sections are attached along a perforation which provides for optional use of the invention wherein both card sections can be folded together to contain, for mailing, an exposed picture and concealed message, or the first card section can be detached from the second card section and mailed individually as a postcard.

2 Claims, 5 Drawing Figures

MESSAGE
MESSAGE
MESSAGE

APERTURED MAILING CARD AND METHOD OF USING

BACKGROUND AND OBJECTS

The present invention relates to cards for mailing objects such as pictures or photographs.

Mailing cards of this type have been provided in the form of postcards having an adhesive surface which enables pictures or photographs and the like to be attached to the card before mailing. In this manner, a sender can create his own picture postcard. Reference may be had to U.S. Pat. Nos. 3,304,641; 3,847,325; and 3,346,172 for examples of postcards of this type. In some known articles of this type both sides of the card are exposed so that a message inscribed on the card would not necessarily be kept private. It would be desirable to enable a sender to have the option of keeping the message private, if desired, while at the same time exposing the picture.

It is, therefore, an object of the present invention to provide a novel mailing card which contains a concealed message and an exposed visual display such as a photograph or picture.

It is another object of the invention to provide such a novel mailing card wherein the sender can optionally expose the message as well as the photograph.

SUMMARY OF A PREFERRED EMBODIMENT OF THE INVENTION

These objects are achieved by the present invention in which a mailing card comprises first and second card sections. The first card section contains an adhesive surface for carrying an object such as a photograph. A removable backing sheet can be provided to overlie the adhesive surface. The second card section is attached to the first card section and includes an opening situated for general alignment with the adhesive surface of the first card section when the first and second card sections are in a folded condition. A transparent cover extends across this opening. A sealing strip extends along the second card section and is foldable into engagement with the first card section to secure the card sections in their folded condition. The first and second card sections are attached along a perforation so that the sender has the option of mailing the first and second sections in a folded condition, or detaching the first card section and mailing it alone as a postcard.

THE DRAWINGS

The preferred embodiments is illustrated in the accompanying drawings in which.

DETAILED DESCRIPTION

Figures 1, 2, 3, 4, 5:
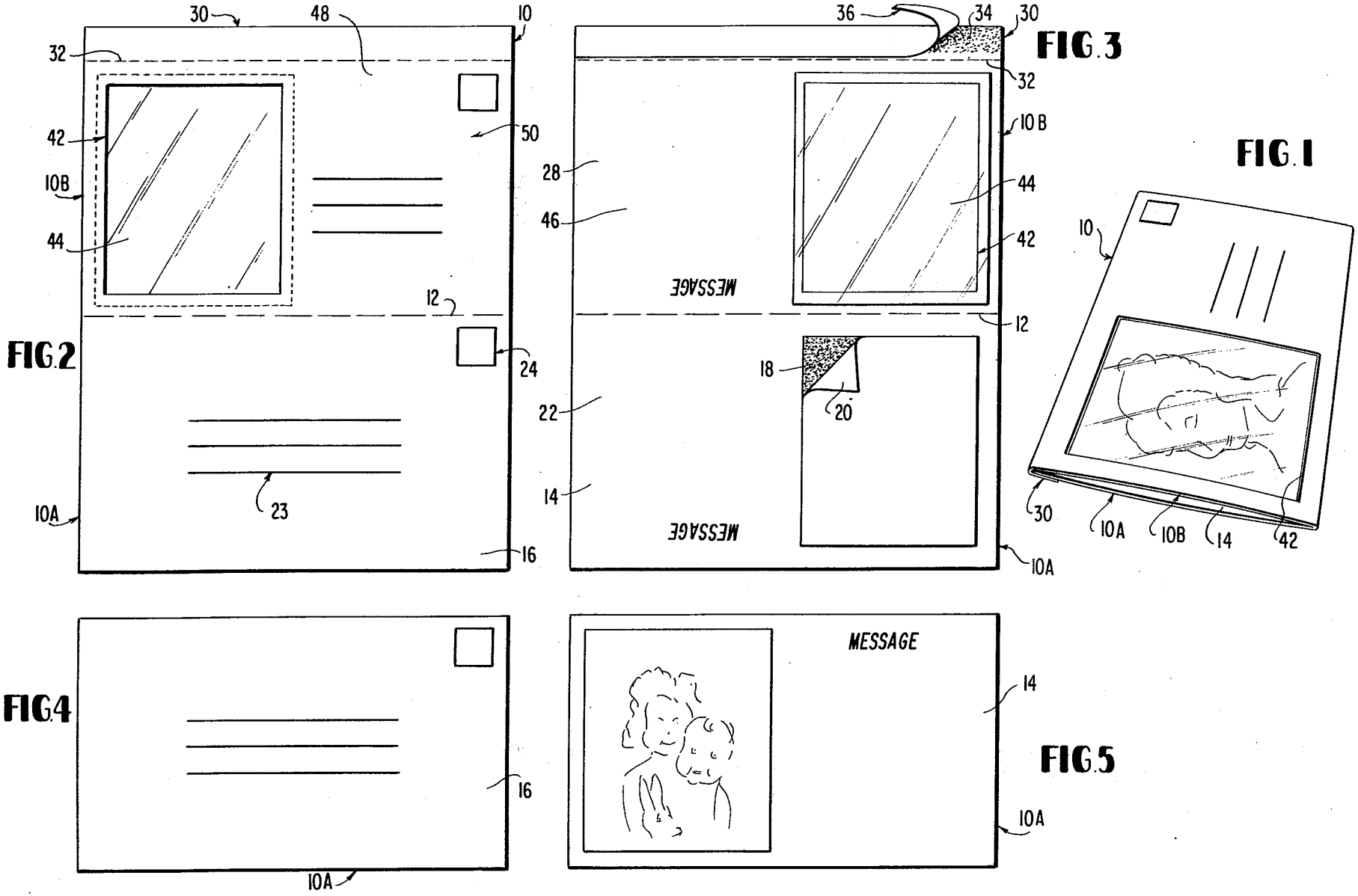
FIG. 1 is an isometric view depicting a condition wherein a pair of card sections is secured in a folded condition according to a first optional use of the present invention.
FIG. 2 is a front view of the card sections depicted in an unfolded, flattened condition.
FIG. 3 is a rear view of the card sections depicted in an unfolded, flattened condition.
FIGS. 4 and 5 are front and rear views, respectively, of an alternate use of the present invention in which one of the card sections is detached from the other card section for separate mailing.

A preferred mailing card 10 is formed of semirigid paper material such as cardboard. The card includes a pair of card sections 10A, 10B. These sections 10A, 10B are joined along a fold line 12 which will be described later in greater detail. A first of the sections 10A has rear and front sides 14, 16, respectively. The rear side 14 has a portion thereof coated with an adhesive substance 18 of a conventional nature and suitable for adhesively carrying a visual display such as a picture or photograph. In this connection, the adhesive substance 18 can be a water activated adhesive or a contact adhesive which is protected by a removable backing material such as a wax coated sheet 20. The adhesive 18 can be applied in any given pattern and area, although it is preferably applied as a continuous surface covering about one-half of the rear side 14. The remaining area 22 of the rear side 14 is preferably left suitable for receiving indicia, such as a message.

The front side 16 of the first card section 10A is suitable for receiving indicia such as an address. In this connection, the rear side 16 can be blank or lines 23 can be inscribed thereon. A corner 24 of this side 16 is suitable for receiving postage.

The second card section 10B has a rear side 28 that is contiguous with the rear side 14 of the first card section 10A. That is, the first and second card sections 10A, 10B are foldable along the fold line 12 to bring the rear sides 14, 28 of the card sections 10A, 10B into facing relationship.

The second card section 10B includes a sealing strip 30 which projects beyond the first card section 10A when the card sections 10A, 10B are in a folded condition. This sealing strip has a scored fold line 32 about which it can be folded into engagement with the front side 16 of the first card section 10A. There is an adhesive coating 34 on a side of the sealing strip 30 which engages the front side 16. This adhesive can be a water-activated adhesive or a contact adhesive having a backing sheet 36.

An opening 42 is formed in the second card section 10B of generally the same size as the adhesive surface 18 on the first card section. The opening is situated so as to be aligned with the adhesive surface 18 when the card sections 10A, 10B are in a folded condition. As a result, a photograph, picture or the like, attached to the adhesive surface 18 will be exposed. Preferably the opening 42 occupies about one-half of the second card section.

A transparent sheet 44 such as cellophane or the like is attached to the first side 28 of the second card section 10B so as to cover the opening 42. The cover sheet 44 can be glued along its edges to the rear side 28 of the second card section 10B.

The nonapertured portion 46 of the second card section 10B is suitable for containing indicia such as a message. A front side 48 of the second card section 10B also includes a section 50 suitable for receiving an address and postage.

The fold line 12 between the first and second card sections is preferably of the perforated type so as to enable the cards to be easily manually detached by a user. In this fashion, the user has the option of mailing the card with the sections 10A, 10B joined together in a folded condition in the manner of an envelope (FIG. 1) or to detach the second card section 10B and mail only the first card section 10A in the manner of a postcard (FIGS. 4–5).

That is, if the user wishes to keep his message private, the message can be inscribed on the rear sides 14, 28 of the first and second card sections 10A, 10B. A photograph or picture, or other object to be mailed, is attached to the adhesive surface 18. Thereupon, the second card section 10B can be folded about the perforated fold line 12, and the sealing strip folded over its fold line 32 and glued to the front side 16 of the first card section 10B. In this manner, the photograph is exposed through the opening 42 and the message is covered (FIG. 1). The card can be addressed and postage applied on either of the exposed sides of the card, i.e., the front sides 16, 48.

On the other hand, the user has the option of separating the card sections along the perforated line 12 and mailing only the first section 10A. in such instance, a photo can be placed onto the adhesive surface 18. An address can be inscribed on one of the sides 14, 16 of the first section, preferably the front side 16, and a message inscribed on the other side 14 in the area 22 adjacent the photograph (FIGS. 4, 5). The card section 10A is then suitable for mailing as a postcard.

Although the present invention has been described with reference to a preferred form thereof, it will be appreciated by those skilled in the art that additions, modifications, substitutions, and deletions may be made without departing from the spirit and scope of the invention as defined in the appended claims.

What is claimed is:

1. A mailing card comprising:

a first card section formed of paper material and having first and second sides;

said first side of said first card section containing an adhesive surface for carrying an object such as a photograph;

a removable backing sheet overlying said adhesive substance;

a second card section formed of paper material attached to said first card section and having an first side contiguous with said first side of said first card section, and a second side contiguous with said second side of said first card section, said second card section including, an opening situated for general alignment with said adhesive surface when said first and second card sections are in a folded condition with said second sides disposed in facing relationship, and a transparent cover extending across said opening; and a sealing strip extending along said second card section so as to extend beyond said first and second card sections when said card sections are in a folded condition, said sealing strip including an adhesive sealing area and being joined to said second card section by a fold line so as to be foldable into enagagement with said first card section to secure said sections in said folded condition for mailing;

said second side of said first card section and said second side of said second card section each including pre-inscribed indicia indicating the positioning of a mailing address and postage to be applied thereto, said first and second card sections being foldably attached along a perforation to enable said first card section to be optionally manually detached from said second card section and mailed separately as a postcard.

2. A method of preparing a card for mailing, said card comprising:

a first card section formed of paper material and having first and second sides;

said first side of said first card section containing an adhesive surface for carrying an object such as a photograph;

a removable backing sheet overlying said adhesive substance;

a second card section formed of paper material attached to said first card section and having a first side contiguous with said first side of said first card section, and a second side contiguous with said second side of said first card section, said second card section including, an opening situated for general alignment with said adhesive surface when said first and second card sections are in a folded condition with said second sides disposed in facing relationship, and a transparent cover extending across said opening; and a sealing strip extending along said second card section so as to extend beyond said first and second card sections when said card sections are in a folded condition, said sealing strip including an adhesive sealing area and being joined to said second card section by a fold line so as to be foldable into engagement with said first card section to secure said sections in said folded condition for mailing;

said second side of said first card section and said second side of said second card section both including pre-inscribed indicia identifying said last-named sides as addressing sides of said card;

said first and second card sections being foldably attached along a perforation to enable said first card section to be optionally manually detached from said second card section and mailed separately as a postcard, said method comprising the steps of:

securing an object such as a photograph to said adhesive surface of said first card section, separating said first card section from said second card section along said perforation, addressing said second side of said first card section for mailing, and mailing said first card section as a picture postcard.

* * * * *